US006361213B2

(12) United States Patent
Randall

(10) Patent No.: US 6,361,213 B2
(45) **Date of Patent: *Mar. 26, 2002**

(54) SLIDING MECHANICAL CLOSURE WITH CONSUMER-RELEASABLE MOTION-LIMITING FEATURES

(75) Inventor: Catherine Jean Randall, Cincinnati, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/296,819

(22) Filed: Apr. 22, 1999

(51) Int. Cl.[7] ..... B65D 33/24
(52) U.S. Cl. ..... 383/64
(58) Field of Search ..... 383/63, 64, 97, 383/69; 24/399, 400, 418; 150/118; 190/119

(56) References Cited

U.S. PATENT DOCUMENTS

| | | | | | |
|---|---|---|---|---|---|
| 1,991,943 | A | * | 2/1935 | Keviczky | 383/97 X |
| 2,071,544 | A | * | 2/1937 | Kroll | 24/418 |
| 2,289,586 | A | * | 7/1942 | Marinsky et al. | 383/97 X |
| 2,303,750 | A | * | 12/1942 | Marinsky | 24/418 |
| 2,495,114 | A | * | 1/1950 | Leguillon et al. | 383/97 |
| 2,616,141 | A | * | 11/1952 | Morin | 24/418 |
| 2,779,370 | A | * | 1/1957 | Wittenberg | 383/97 X |
| 2,962,070 | A | * | 11/1960 | Towles | 383/97 X |
| 4,186,786 | A | | 2/1980 | Kirkpatrick | |
| 4,262,395 | A | * | 4/1981 | Kosky | 24/400 |
| 4,786,190 | A | | 11/1988 | Van Erden et al. | |
| 4,829,641 | A | | 5/1989 | Williams | |
| 4,875,258 | A | * | 10/1989 | Goedecke | 24/389 |
| 4,890,935 | A | * | 1/1990 | Ausnit et al. | 383/64 X |
| 4,907,321 | A | | 3/1990 | Williams | |
| 5,064,664 | A | | 11/1991 | Hustad | |
| 5,067,208 | A | | 11/1991 | Herrington, Jr. et al. | |
| 5,103,979 | A | | 4/1992 | Hustad | |
| 5,117,883 | A | * | 6/1992 | Chen | 383/97 X |
| 5,131,121 | A | | 7/1992 | Herrington, Jr. et al. | |
| 5,161,286 | A | | 11/1992 | Herrington, Jr. et al. | |
| 5,189,764 | A | * | 3/1993 | Herrington et al. | 24/399 X |
| 5,248,201 | A | | 9/1993 | Kettner et al. | |
| 5,301,394 | A | | 4/1994 | Richardson et al. | |
| 5,301,395 | A | | 4/1994 | Richardson et al. | |
| 5,356,222 | A | | 10/1994 | Kettner et al. | |
| 5,442,837 | A | * | 8/1995 | Morgan | 24/400 |
| 5,470,156 | A | | 11/1995 | May | |

(List continued on next page.)

FOREIGN PATENT DOCUMENTS

| | | |
|---|---|---|
| FR | 858850 | 12/1940 |

*Primary Examiner*—Jes F. Pascua
(74) *Attorney, Agent, or Firm*—Peter D. Meyer; Leonard W. Lewis

(57) ABSTRACT

The present invention provides a flexible storage bag having an opening, a mechanical interlocking seal for closing the opening, and a slider for sealing the mechanical interlocking seal. The slider includes a mechanical manually-releasable locking element for preventing accidental movement of the slider. The locking element may comprise a pivotally releasable locking element, such as a pivotally mounted loop of material, or a button which when depressed releases an internal locking mechanism within the slider, or an internal locking mechanism within the slider which is released by manually compressing the slider. Locking elements in accordance with the present invention may be automatically engaged and manually released by the consumer, or may be manually engaged and released. Locking elements may also secure the slider in other positions, such as opened and intermediate/partially opened positions, in addition to or instead of the closed position. Multiple locking elements may be provided of the same or diverse types.

3 Claims, 2 Drawing Sheets

U.S. PATENT DOCUMENTS 5,474,382 A 12/1995 May
5,486,051 A 1/1996 May
5,489,252 A 2/1996 May
5,509,735 A 4/1996 May
5,513,915 A 5/1996 May
5,527,112 A 6/1996 Dais et al.
5,551,127 A 9/1996 May
5,564,834 A 10/1996 Porchia et al.
5,647,671 A 7/1997 May
5,681,115 A * 10/1997 Diederich et al. ..... 383/64
6,036,364 A * 3/2000 Heuvel ..... 383/64
6,074,094 A * 6/2000 Manolizi et al. ..... 383/69 X

* cited by examiner

SLIDING MECHANICAL CLOSURE WITH CONSUMER-RELEASABLE MOTION-LIMITING FEATURES

FIELD OF THE INVENTION

The present invention relates to sliding mechanical closures such as those commonly employed on flexible storage bags, particularly those suitable for use in the containment and protection of various items including perishable materials.

BACKGROUND OF THE INVENTION

Flexible storage bags for use in the containment and protection of various items, as well as the preservation of perishable materials such as food items, are well known in the art. Such bags typically comprise a rectangular sheet of polymeric film folded upon itself and sealed along two edges to form a semi-enclosed container having two flexible opposed sidewalls, three sealed or folded edges, and one open edge. A closure integrally formed with the bag such as an interlocking rib-type seal or separately provided such as a plastic or paper-clad-wire tie completes the containment assembly.

As utilized herein, the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity. Flexible storage bags of the foregoing variety are typically formed from polymeric film, such as polyethylene or other members of the polyolefin family, in thicknesses of between about 0.0002 inches to about 0.002 inches. Such films are frequently transparent but sometimes are opaque and/or colored.

Flexible storage bags of the currently commercially available variety provide a means of conveniently storing a wide range of objects and materials in a generally disposable containment device. Flexible storage bags with sliding mechanical closures have been developed to improve the ease of opening and closing mechanical interlocking seals. While such sliding mechanical closures have proven suitable for such uses, there remains the issue of consumer confidence that the sliding mechanical closure will resist inadvertent opening.

Accordingly, it would be desirable to provide a sliding mechanical closure which provides for increased security against accidental opening.

SUMMARY OF THE INVENTION

The present invention provides a flexible storage bag having an opening, a mechanical interlocking seal for closing the opening, and a slider for sealing the mechanical interlocking seal. The slider includes a mechanical manually-releasable locking element for preventing accidental movement of the slider.

The locking element may comprise a pivotally releasable locking element, such as a pivotally mounted loop of material, or a button which when depressed releases an internal locking mechanism within the slider, or an internal locking mechanism within the slider which is released by manually compressing the slider.

Locking elements in accordance with the present invention may be automatically engaged and manually released by the consumer, or may be manually engaged and released. Locking elements may also secure the slider in other positions, such as opened and intermediate/partially opened positions, in addition to or instead of the closed position. Multiple locking elements may be provided of the same or diverse types.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
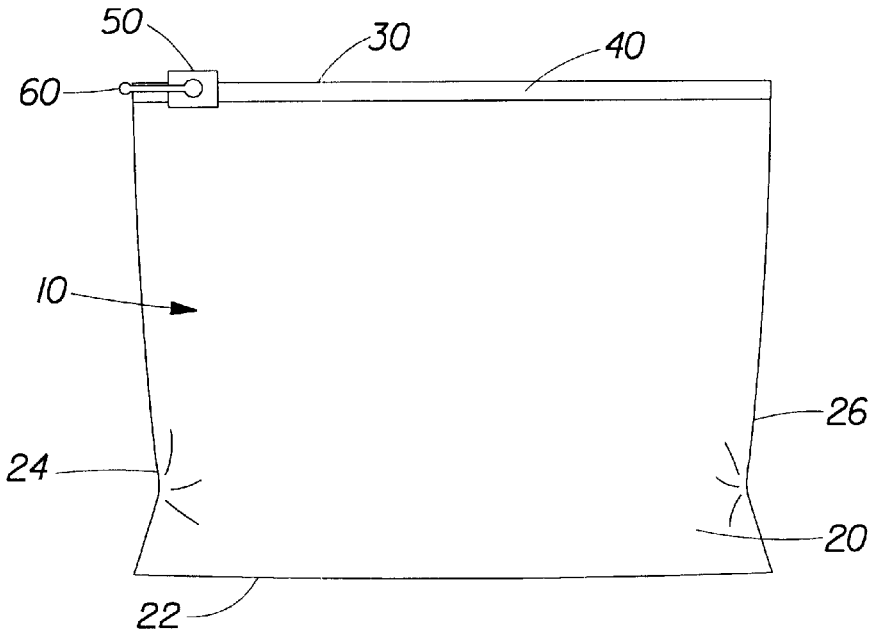
FIG. 1 is an elevational view of a flexible storage bag employing a sliding mechanical closure in accordance with the present invention in a closed and secured condition.

FIG. 1 depicts one embodiment of a flexible storage bag 10 according to the present invention. In the embodiment depicted in FIG. 1, the flexible storage bag 10 includes a bag body 20 formed from a piece of flexible sheet material folded upon itself along fold line 22 and bonded to itself along side seams 24 and 26 to form a semi-enclosed container having an opening along edge 30. Flexible storage bag 10 also includes a mechanical closure 40 located adjacent to edge 30 for sealing edge 30 to form a fully-enclosed container or vessel. Bags such as the flexible storage bag 10 of FIG. 1 can be also constructed from a continuous tube of sheet material, thereby eliminating side seams 24 and 26 and substituting a bottom seam for fold line 22.

Figure 2:
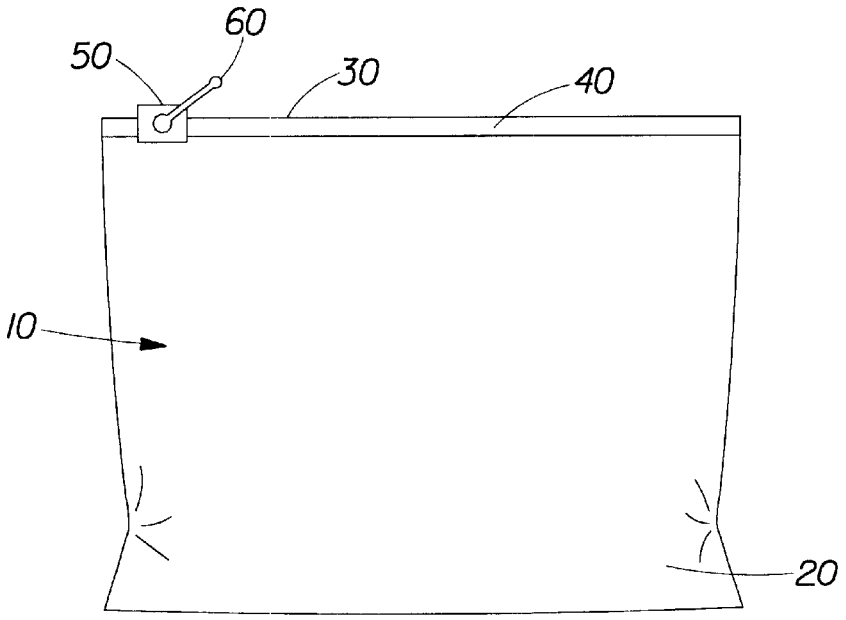
FIG. 2 is an elevational view of the flexible storage bag of FIG. 1 in an unsecured condition.

As shown in FIG. 1, the mechanical closure 40 includes an interlocking mechanical seal of any suitable conventional design. The mechanical closure 40 also includes a slider 50 of suitable conventional design for the type of interlocking mechanical seal employed in mechanical closure 40, but in accordance with the present invention including a mechanical releasable locking element 60. The mechanical manually-releasable locking element 60 in the embodiment of FIGS. 1 and 2 comprises a pivotally-mounted loop, such as a plastic strip, attached to the slider 50 which may be pivoted downward and looped around the end of the edge 30 to prevent the slider from moving away from that end without upwardly pivoting and releasing the locking element 60, as shown in FIG. 2. The consumer therefore has confidence that unless an affirmative step is taken to physically move and unlock the slider element, the closure will provide the desired protection.

Figure 3:
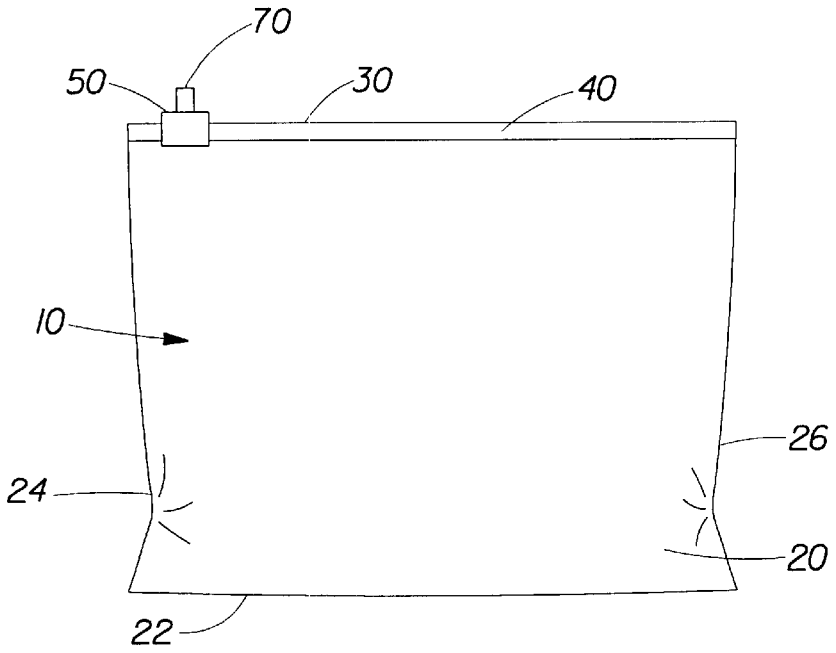
FIG. 3 is an elevational view of another flexible storage bag employing another embodiment of a sliding mechanical closure in accordance with the present invention.
Figure 4:
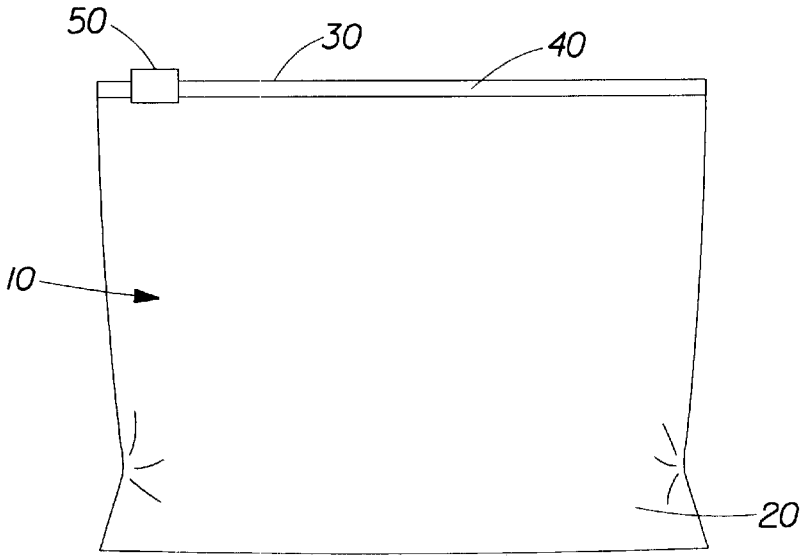
FIG. 4 is an elevational view of another flexible storage bag employing a further embodiment of a sliding mechanical closure in accordance with the present invention.

FIG. 3 depicts another embodiment of a flexible storage bag 10 having a slider 50 secured by a locking element 70 in the form of a button which must be manually depressed to release an internal locking mechanism within the slider 50 to permit opening of the closure. FIG. 4 depicts a further embodiment of a flexible storage bag 10 having a slider 50 secured by an internal locking mechanism which is released by squeezing the slider 50 to release the slider for movement and accompanying opening of the closure.

Locking elements in accordance with the present invention may be automatically engaged and manually released by the consumer, or may be manually engaged and released. Locking elements may also secure the slider in other positions, such as opened and intermediate/partially opened positions, in addition to or instead of the closed position. Multiple locking elements may be provided of the same or diverse types.

Various compositions suitable for constructing the flexible storage bags of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance.

Once the desired sheet materials are manufactured in any desirable and suitable manner, comprising all or part of the materials to be utilized for the bag body, the bag may be constructed in any known and suitable fashion such as those known in the art for making such bags in commercially available form. Heat or adhesive sealing technologies may be utilized to join various components or elements of the bag to themselves or to each other. In addition, the bag bodies may be thermoformed, blown, or otherwise molded rather than reliance upon folding and bonding techniques to construct the bag bodies from a web or sheet of material. Two recent U.S. Patents which are illustrative of the state of the art with regard to flexible storage bags similar in overall structure to those depicted in FIGS. 1 and 2 but of the types currently available are U.S. Pat. No. 5,554,093, issued Sep. 10, 1996 to Porchia et al., and U.S. Pat. No. 5,575,747, issued Nov. 19, 1996 to Dais et al.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible storage bag comprising:

(a) a bag having an opening;

(b) a mechanical interlocking seal for closing said opening;

(c) a slider movable along and interacting with said mechanical interlocking seal for sealing said mechanical interlocking seal, said slider including a mechanical manually-releasable locking element comprising a pivotally mounted loop of material; and, wherein said pivotally mounted loop is pivoted around an edge of said flexible bag.

2. The flexible storage bag of claim 1, wherein said locking element is pivotally releasable.

3. The flexible storage bag of claim 1, wherein said locking element is manually engaged and manually released.

* * * * *